US009922472B2

(12) United States Patent
Jergess et al.

(10) Patent No.: US 9,922,472 B2
(45) Date of Patent: Mar. 20, 2018

(54) VEHICLE COMMUNICATION STATUS INDICATOR

(71) Applicant: Ford Global Technologies, LLC, Dearborn, MI (US)

(72) Inventors: Rafic Jergess, Warren, MI (US); John Robert Van Wiemeersch, Novi, MI (US); Howard Paul Tsvi Linden, Southfield, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/238,390

(22) Filed: Aug. 16, 2016

(65) Prior Publication Data

US 2018/0053360 A1 Feb. 22, 2018

(51) Int. Cl.

| | |
|---|---|
| ***G07C 9/00*** | (2006.01) |
| ***G08B 5/36*** | (2006.01) |
| *E05B 81/76* | (2014.01) |
| *E05B 81/78* | (2014.01) |

(52) U.S. Cl.

CPC ..... *G07C 9/00007* (2013.01); *G07C 9/00309* (2013.01); *G08B 5/36* (2013.01); *E05B 81/76* (2013.01); *E05B 81/77* (2013.01); *E05B 81/78* (2013.01); *G07C 2009/00769* (2013.01)

(58) Field of Classification Search

CPC ..... G07C 9/00007; G07C 9/00309; G07C 2009/00769; G08B 5/36; E05B 81/76; E05B 81/77; E05B 81/78

See application file for complete search history.

(56) References Cited

U.S. PATENT DOCUMENTS

| | | | | |
|---|---|---|---|---|
| 3,997,868 | A * | 12/1976 | Ribnick | G08G 1/0965 340/902 |
| 6,621,178 | B2 | 9/2003 | Morillon | |
| 7,106,171 | B1 * | 9/2006 | Burgess | B60R 25/23 340/10.42 |
| 8,594,616 | B2 | 11/2013 | Gusikhin et al. | |
| 8,706,350 | B2 * | 4/2014 | Talty | B60R 25/24 701/36 |
| 9,008,917 | B2 | 4/2015 | Gautama et al. | |

(Continued)

FOREIGN PATENT DOCUMENTS

| | | | |
|---|---|---|---|
| DE | 102013219380 | A1 | 3/2015 |
| JP | 2005008149 | A | 1/2015 |

(Continued)

OTHER PUBLICATIONS

Search Report dated Jan. 15, 2018, for GB Patent Application No. GB 1713040.2 (6 Pages).

*Primary Examiner* — Thomas Alunkal
(74) *Attorney, Agent, or Firm* — James P. Muraff; Neal, Gerber & Eisenberg LLP

(57) ABSTRACT

Systems and methods are disclosed for a vehicle communication status indicator. An example disclosed vehicle includes a body control module and a keyless entry unit. The example body control unit determines whether a mobile device is authorized to act as a key. The example keyless entry unit is communicatively coupled to the body control module. The example keyless entry unit activates an indicator LED when the mobile device is connected to a wireless node. The indicator LED emits a first color when the mobile device is authorized.

18 Claims, 5 Drawing Sheets

(56) References Cited

U.S. PATENT DOCUMENTS

| | | | | |
|---|---|---|---|---|
| 9,050,930 | B2 * | 6/2015 | Walsh | G08G 1/167 |
| 9,704,402 | B2 * | 7/2017 | Alanazi | G08G 1/16 |
| 2003/0031025 | A1 | 2/2003 | Huzienga | |
| 2004/0104815 | A1 * | 6/2004 | Suyama | B60Q 1/323 340/426.16 |
| 2006/0226953 | A1 | 10/2006 | Shelley et al. | |
| 2006/0232379 | A1 | 10/2006 | Shelley et al. | |
| 2006/0274540 | A1 * | 12/2006 | Klaver | H05B 33/0857 362/479 |
| 2007/0195542 | A1 | 8/2007 | Metros et al. | |
| 2008/0001708 | A1 * | 1/2008 | Nakashima | B60R 25/2009 340/5.72 |
| 2009/0160211 | A1 * | 6/2009 | Krishnan | B60J 5/04 296/146.4 |
| 2014/0000165 | A1 * | 1/2014 | Patel | E05B 81/76 49/31 |
| 2014/0285113 | A1 * | 9/2014 | Huang | H05B 37/0272 315/297 |
| 2014/0347164 | A1 | 11/2014 | De Wind et al. | |
| 2015/0130642 | A1 * | 5/2015 | Huang | B62D 15/028 340/932.2 |
| 2015/0362997 | A1 | 12/2015 | Hatton | |
| 2016/0011661 | A1 * | 1/2016 | Tanaka | G06F 3/0346 345/589 |

FOREIGN PATENT DOCUMENTS

| | | | |
|---|---|---|---|
| WO | WO 2014181303 | A1 | 11/2014 |
| WO | WO 2015/1168459 | A | 11/2015 |

* cited by examiner

VEHICLE COMMUNICATION STATUS INDICATOR

TECHNICAL FIELD

The present disclosure generally relates to vehicle remote keyless entry systems and, more specifically, a vehicle communication status indicator.

BACKGROUND

Remote keyless entry systems facilitate unlocking and opening doors of a vehicle without inserting a key into a lock. A key fob may include a wireless transducer that communicates with the vehicle to authorize entry into the vehicle while the key fob is, for example, inside a driver's pocket. Increasingly, applications operating on phones are used in place of the key fob to enable the remote keyless entry system.

SUMMARY

The appended claims define this application. The present disclosure summarizes aspects of the embodiments and should not be used to limit the claims. Other implementations are contemplated in accordance with the techniques described herein, as will be apparent to one having ordinary skill in the art upon examination of the following drawings and detailed description, and these implementations are intended to be within the scope of this application.

Systems and methods are disclosed for a vehicle communication status indicator. An example disclosed vehicle includes a body control module and a keyless entry unit. The example body control unit determines whether a wireless access device is authorized to act as a key. For example, the mobile device may be a Smart Phone with BLUETOOTH Low Energy (BLE) communication capability and/or a Key Fob with BLE. The example keyless entry unit is communicatively coupled to the body control module. The example keyless entry unit activates an indicator LED or back-lit graphic when the wireless access device is connected to a wireless node. The indicator LED emits a first color when the wireless access device is authorized.

An example disclosed method includes determining whether a wireless access device is authorized to act as a key. Additionally, the example method includes activating, on a keyless entry unit, a connection indicator LED when the wireless access device is connected to a vehicle-based wireless node. The example connection indicator LED emits a first color.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION OF EXAMPLE EMBODIMENTS

Figure 1A:
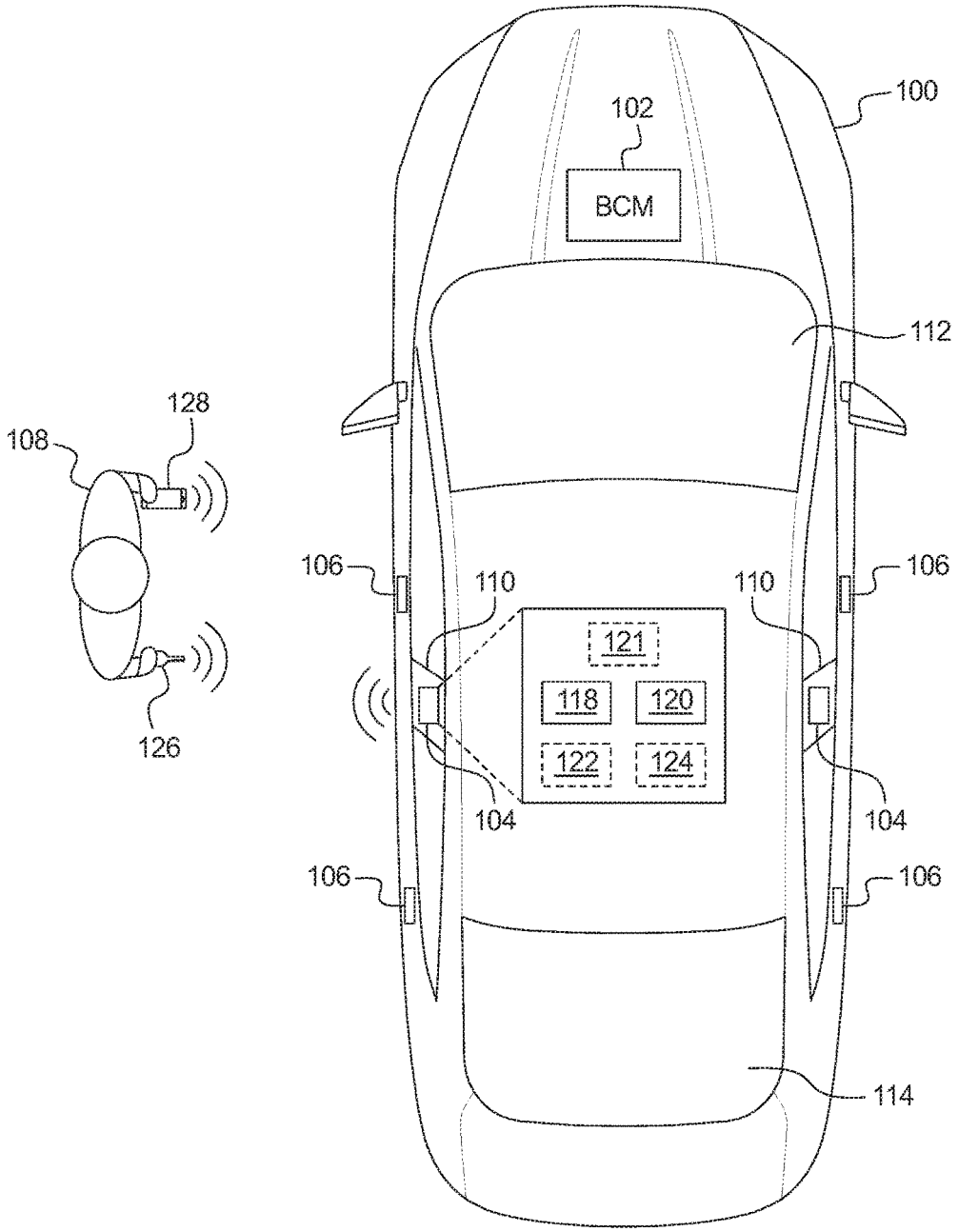
FIGS. 1A and 1B illustrate a vehicle with a vehicle communication status indicator in accordance with the teaching of this disclosure.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

Key fobs and/or mobile devices (e.g., smart phones, smart watches, etc.) wireless connect to the vehicle to facilitate unlocking the vehicle by a keyless entry system. As used herein, "wireless access device" refers to key fobs and mobile devices that include short-range wireless nodes that are configurable to communicate with the vehicle (e.g., through a pairing process). Users of keyless entry system may get frustrated when they are near the vehicle, but the keyless entry system does not unlock the doors. Additionally, antenna(s) for a short-range wireless node should be located so that the wireless access device connects with the keyless entry system when the user is in range of the vehicle. As disclosed below, a keyless entry unit includes a wireless node and an indicator to inform the user when the wireless access device is communicatively coupled to the keyless entry system. In some examples, the keyless entry unit includes a keypad to facilitate unlocking the doors to the vehicle. In some examples, the keyless entry unit located on a portion of a door overlapping a B-pillar of the vehicle. The B-pillar is a roof support structure located between the front and rear doors. Alternatively, in some examples, the keyless entry unit may be located at a driver's side edge of a front windshield or in an upper middle portion of a back wind shield. It may also be located on any side of the vehicle.

When the wireless access device is communicatively coupled to the wireless node of the keyless entry unit, the indicator activates. In some examples, the indicator includes a blue, dimmable light emitting diode (LED). In some such examples, the brightness of the blue LED is based on a received signal strength indicator (RSSI) or a received transmission strength (RX) between the wireless node and the wireless access device. The RSSI and RX values measure open-path signal strength of the signal between the wireless access device and the wireless node of the keyless entry unit. The RSSI and RX values are determined by the wireless access device when it receives a message from the vehicle. Additionally, the wireless access device includes the RSSI value or the RX value with messages it sends to the wireless node of the keyless entry unit. When the wireless access device is within a threshold range (e.g., two to three meters, etc.) of the vehicle and the vehicle has authenticated the wireless access device, the vehicle, via a body control module (BCM), primes one or more doors to be unlocked. For example, a door control unit may be set to unlock the corresponding door when a person's hand is detects on the door handle.

Figure 1B:
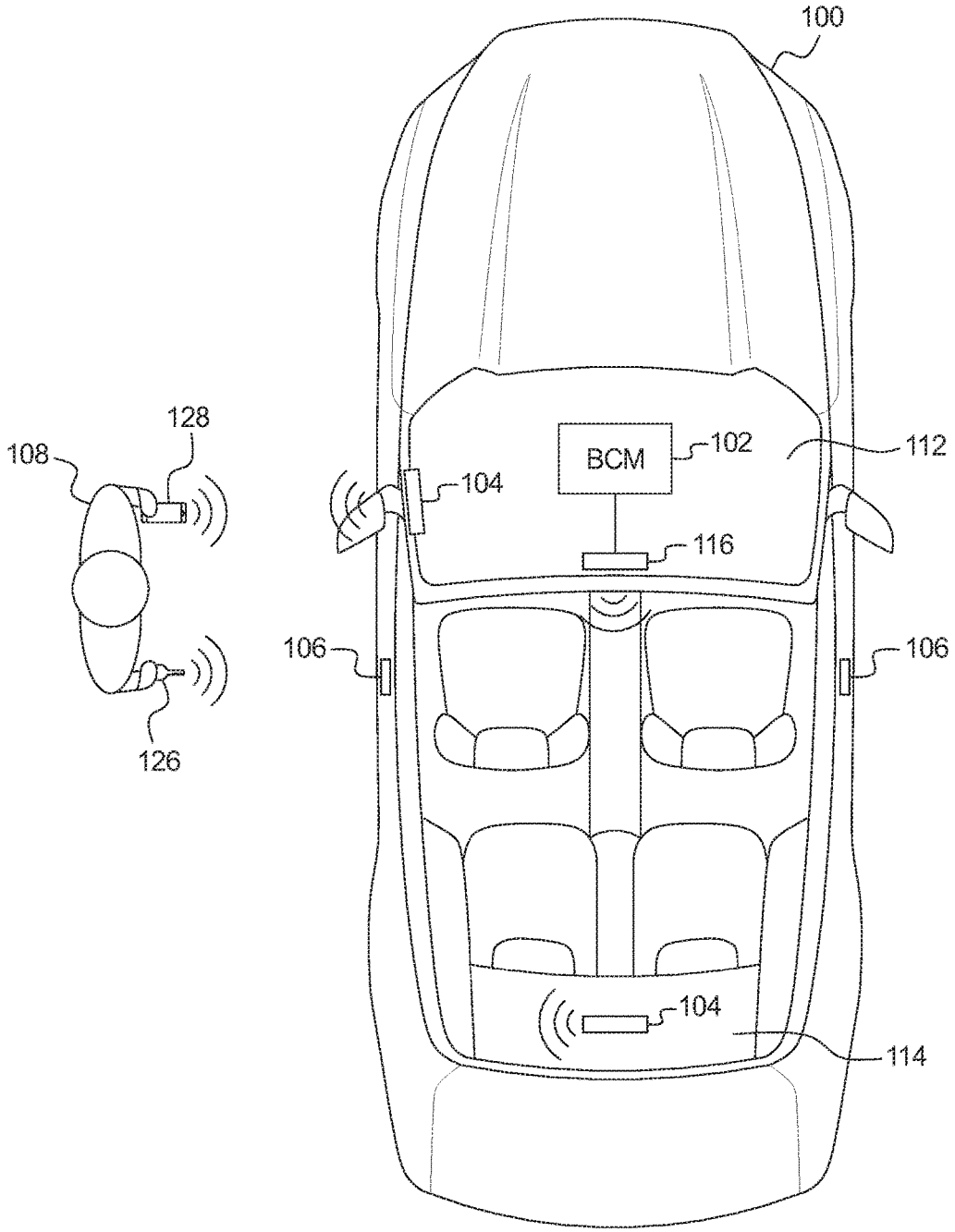

FIGS. 1A and 1B illustrate a vehicle 100 with a vehicle communication status indicator in accordance with the teaching of this disclosure. FIG. 1A depicts a standard vehicle 100. FIG. 1B depicts a convertible vehicle 100. The vehicle 100 may be a standard gasoline powered vehicle, a hybrid vehicle, an electric vehicle, a fuel cell vehicle, and/or any other mobility implement type of vehicle. The vehicle 100 includes parts related to mobility, such as a powertrain with an engine, a transmission, a suspension, a driveshaft, and/or wheels, etc. Additionally, the vehicle 100 may be non-autonomous, semi-autonomous or autonomous. In the illustrated examples, the vehicle 100 includes a body control module 102 and a keyless entry unit 104.

The body control module 102 controls various subsystems of the vehicle 100. For example, the body control module 102 may control power windows, power locks, an immobilizer system, and/or power mirrors, etc. The body control module 102 includes circuits to, for example, drive relays (e.g., to control wiper fluid, etc.), drive brushed direct current (DC) motors (e.g., to control power seats, power locks, power windows, wipers, etc.), drive stepper motors, and/or drive LEDs, etc. The body control module 102 is communicatively coupled with door electronic latches 106 on the doors. The door electronic latches 106 lock and unlock the vehicle. In some examples, the door electronic latch 106 is coupled to a sensor (e.g., capacitive touch sensors, infrared sensors, an angular rotation sensor, etc.) to detect when a user 108 is attempting to open a door. In some such examples, the body control module 102 sends a signal that causes the door electronic latches 106 to unlock the corresponding door in response to detecting, via the sensor, the user 108 attempting to open the door (sometimes referred to herein as "priming the door."). As discussed below, the body control module 102 primes the door electronic latches 106 based on (a) an authorized device communicatively coupled to the keyless entry unit 104 and/or (b) a pass code being entered into the keyless entry unit 104.

In the illustrated example of FIG. 1A, the keyless entry unit 104 is located on one or more doors (e.g. a driver's side front door, a passenger's side front door, etc.) on a portion the door overlapping a B-pillar 110 of the vehicle 100. In the illustrated example of FIG. 1B, the keyless entry unit 104 may be located on an edge of a front windshield 112 or an upper middle portion of a rear windshield 114. Additionally, the vehicle 100 may include a short-range wireless node 116 that communicatively couples to the keyless entry unit 104. The keyless entry unit 104 of FIGS. 1A and 1B include a short-range wireless node 118 and a communication-state indicator led 120. In some examples, the keyless entry unit 104 includes a lock-state indicator LED 121. Additionally, in some examples, the keyless entry unit includes a keypad 122 and a keypad LED 124.

The short-range wireless node 118 includes hardware and firmware to implement a short-range wireless network. In some examples, the short-range wireless node 118 implements BLUETOOTH Low Energy (BLE). The BLE protocol is set forth in Volume 6 of the BLUETOOTH Specification 4.0 (and subsequent revisions) maintained by the BLUETOOTH Special Interest Group. Alternatively, in some examples, the short-range wireless node 118 may implement another wireless protocol, such as Institute of Electrical and Electronics Engineers' (IEEE) 802.15.4 (e.g., Zigbee®) or IEEE 802.11 (e.g., a wireless local area network (WLAN)). The short-range wireless node 118 communicatively couples to a paired key fob 126 and/or a paired mobile device 128. Messages sent from the key fob 126 and/or the mobile device 128 include an RSSI value and/or an RX value. The RSSI value and RX value measure the open-path signal strength between the short-range wireless node 118 and the key fob 126 and/or the mobile device 128. The RSSI is measured in signal strength percentage, the values (e.g., 0-100, 0-137, etc.) of which are defined by a manufacturer of hardware used to implement the short-range wireless node 118. Generally, a higher RSSI means that (a) the key fob 126 and/or the mobile device 128 is closer to the vehicle 100, and (b) the communication between the key fob 126 and/or the mobile device 128 and the short-range wireless node 118 is more reliable. The RX values are measured in Decibel-milliWatts (dBm). Additionally, the short-range wireless node 116 of the vehicle 100 is includes hardware and firmware to implement the short-range wireless network (e.g., BLE, WLAN, ZIGBEE, etc.).

The short-range wireless node 118 is communicatively coupled to the body control module 102. In some examples, when a connection is established between a key fob 126 and/or a mobile device 128, the body control module 102 interrogates the key fob 126 and/or the mobile device 128 to determine whether the key fob 126 and/or the mobile device 128 is authorized to access the vehicle 100. In some examples, the body control module 102 and the key fob 126 and/or the mobile device 128 exchange one or more authorization tokens. In some examples, the body control module 102 determines a distance between the key fob 126 and/or the mobile device 128 and the vehicle 100 based on the RSSI value and/or the RX value. For example, a higher RSSI values means that the key fob 126 and/or the mobile device 128 is closer to the vehicle 100. In such examples, when (a) the key fob 126 and/or the mobile device 128 is authorized and (b) the key fob 126 and/or the mobile device 128 is within a range threshold (e.g., five feet, ten feet, etc.), the body control module 102 primes the door electronic latches 106.

The communication-state indicator LED 120 illuminates a communication-state indicator panel (e.g., the communication-state indicator panel 204 of FIG. 2 below) to indicate when the key fob 126 and/or the mobile device 128 is communicatively coupled to the short-range wireless node 116 of the vehicle 100 and is authorized to act as the key. In some examples, the communication-state indicator led 120 emits a blue color (e.g., between a 470 nanometer (nm) wavelength and a 525 nm wavelength). Alternatively, in some examples, the communication-state indicator led 120 is an LED pixel that includes LEDs of multiple colors (e.g. a red LED, a green LED, and a blue LED) so that the color of the communication-state indicator led 120 is configurable and/or changeable. Additionally, in some examples, the communication-state indicator led 120 is dimmable so that the brightness of the communication-state indicator led 120 is based on the signal strength (e.g., the RSSI value or the RX value) between the short-range wireless node 118 and the key fob 126 and/or the mobile device 128. The communication-state indicator led 120 emits the blue color when (i) the key fob 126 and/or the mobile device 128 is communicatively coupled to the short-range wireless node 118 and (ii) the key fob 126 and/or the mobile device 128 is authorized to act as a key. The communication-state indicator led 120 is off when the key fob 126 and/or the mobile device 128 is not communicatively coupled to the short-range wireless node 118 or the key fob 126 and/or the mobile device 128 is not authorized to act as the key. In some examples, the communication-state indicator led 120 emits a red or yellow color (e.g., between a 620 nm wavelength and a 580 nm wavelength) when key fob 126 and/or the mobile device 128 is communicatively coupled to the short-range wireless node 118, but the key fob 126 and/or the mobile device 128 is not close enough to the vehicle to activate keyless entry (e.g., greater than two to three meters, etc.).

In some examples, the lock-state indicator LED 121 illuminates a lock-state indicator panel (e.g., the lock-state indicator panel 205 of FIG. 2 below) to indicate when the doors are openable. In some examples, the lock-state indicator LED 121 emits a blue color (e.g., between a 470 nanometer (nm) wavelength and a 525 nm wavelength). Alternatively, in some examples, the lock-state indicator LED 121 is an LED pixel that includes LEDs of multiple colors (e.g. a red LED, a green LED, and a blue LED) so that the color of the lock-state indicator LED 121 is configurable and/or changeable. The lock-state indicator LED 121 illuminates the lock-state indicator panel when the key fob 126 and/or the mobile device 128 is (a) authorized to act as the key, and (b) the key fob 126 and/or the mobile device 128 is within range of the vehicle 100 to activate keyless entry (e.g., within two to three meters, etc.).

The keypad 122 includes numeric or alphanumeric button (e.g., the buttons 206 of FIG. 2 below). In some examples, the buttons are tilt push buttons that indicate one value when pressure is applied to one side of the button and indicate a different value when pressure is applied to the opposite side of the button. Alternatively, in some examples, the buttons may be capacitive touch, piezoelectric, or resistive touch-based buttons. The keypad 122 is communicatively coupled to the body control module 102. In some examples, the body control module 102 primes the door electronic latches 106 in response to the body control module 102 verifying a pass code entered into the keypad 122. Alternatively, in some examples, the body control module 102 primes the door electronic latches 106 when (a) the pass code is entered into the keypad 122, and (b) the key fob 126 and/or the mobile device 128 is within the threshold range (e.g., two to three meters, etc.) of the vehicle 100.

The keypad LED(s) 124 illuminate(s) the buttons of the keypad 122. The keypad LED(s) 124 illuminate(s) when the user 108 is detected, by for example, a sensor (e.g., an infrared sensor, an ultrasonic sensor, etc.) or when the key fob 126 and/or the mobile device 128 is detected. The color of the keypad LED(s) 124 is based on whether the door electronic latches 106 are primed. When the door electronic latches 106 are not primed, the keypad LED(s) 124 emit(s) in a red or yellow color (e.g., between a 620 nanometer nm wavelength and a 580 nm wavelength). When the door electronic latches 106 are primed, the keypad LED(s) 124 emit(s) a green color (e.g., between a 495 nm wavelength and a 570 nm wavelength). In some examples, when the door electronic latches 106 are primed, the lock-state indicator LED 121 illuminates a lock-state indicator panel to indicate that the doors are openable.

Figure 2:
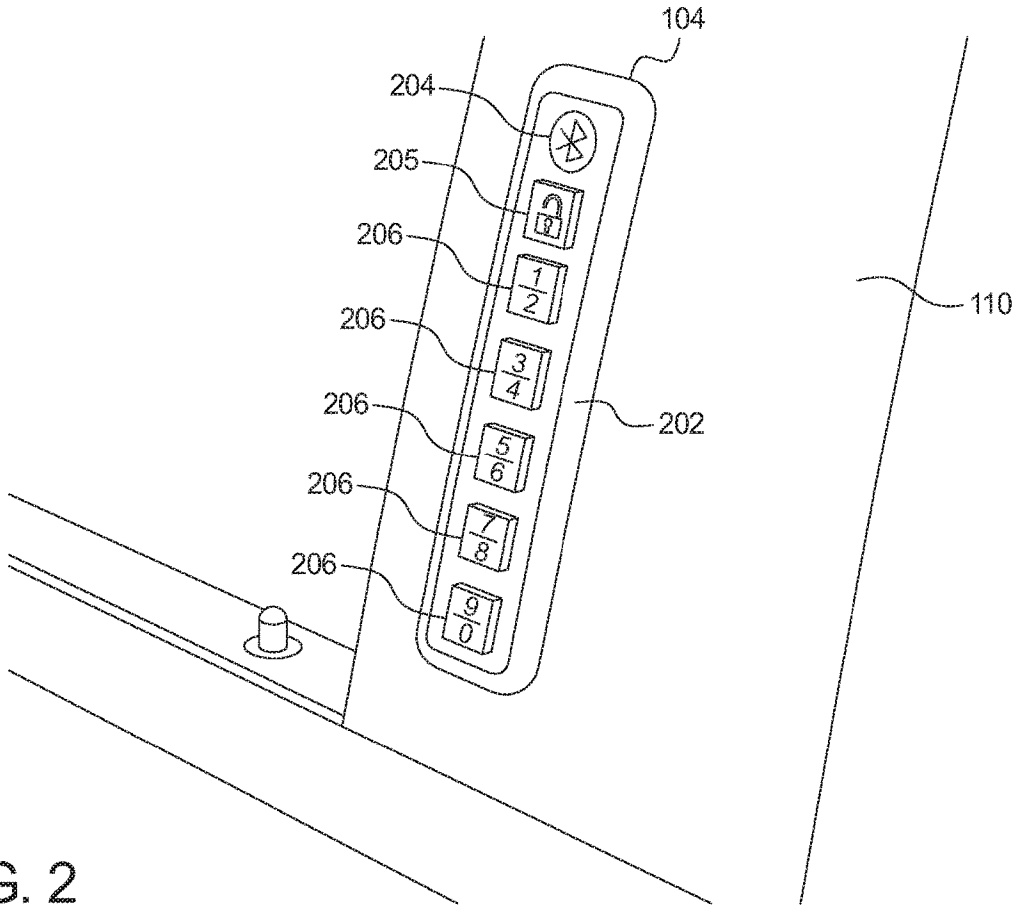
FIG. 2 illustrates an example of the keyless entry unit of FIG. 1.

FIG. 2 illustrates an example of the keyless entry unit 104 of FIG. 1. In the illustrated example of FIG. 2, the keyless entry unit 104 is located on a portion of the door proximate the B-pillar 110 of the vehicle 100. In the illustrated example, the keyless entry unit 104 includes a housing 202, a communication-state indicator panel 204, and buttons 206 of the keypad 122. In some examples, the keyless entry unit 104 includes a lock-state indicator panel 205. Additionally, in some examples, the keyless entry unit 104 does not include the buttons 206. The housing 202 includes the short-range wireless node 118 (e.g., the corresponding controller and the antenna) and the communication-state indicator led 120. Additionally, in some examples, the housing 202 includes the keypad LED 124.

Figure 3A:
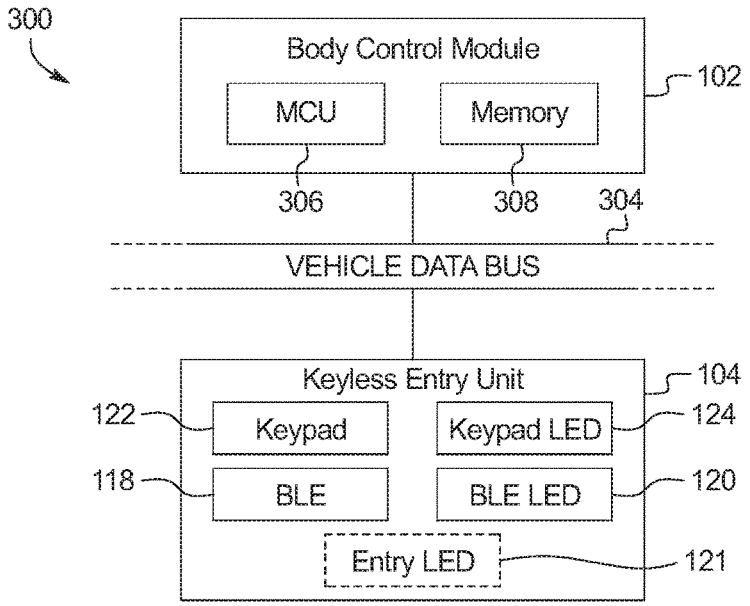
FIGS. 3A and 3B are block diagrams of electronic components of the vehicle of FIGS. 1A and 1B.
Figure 3B:
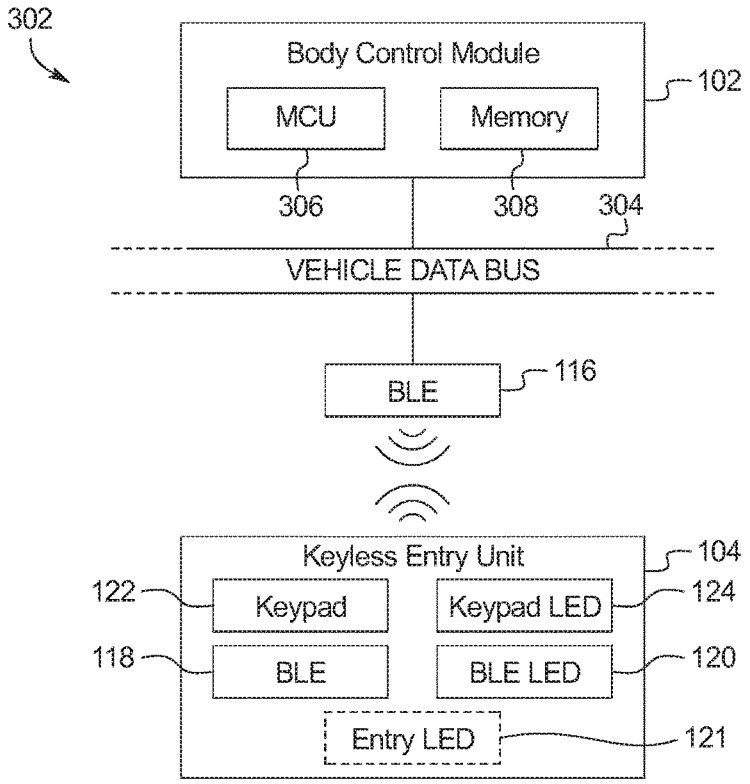

FIG. 3A is a block diagram of electronic components 300 of the vehicle 100 of FIG. 1A. FIG. 3B is a block diagram of electronic components 302 of the vehicle 100 of FIG. 1B. In the illustrate examples of FIGS. 3A and 3B, the electronic components 300 and 302 include the body control module 102, the keyless entry unit 104, and a vehicle data bus 304. In the illustrated example of FIG. 3B, the electronic components 302 includes in the short-range wireless node 116.

The body control module 102 includes a processor or controller 306 and memory 308. The processor or controller 306 may be any suitable processing device or set of processing devices such as, but not limited to: a microprocessor, a microcontroller-based platform, a suitable integrated circuit, one or more field programmable gate arrays (FPGAs), and/or one or more application-specific integrated circuits (ASICs). The memory 308 may be volatile memory (e.g., RAM, which can include non-volatile RAM, magnetic RAM, ferroelectric RAM, and any other suitable forms); non-volatile memory (e.g., disk memory, FLASH memory, EPROMs, EEPROMs, memristor-based non-volatile solid-state memory, etc.), unalterable memory (e.g., EPROMs), read-only memory, and/or high-capacity storage devices (e.g., hard drives, solid state drives, etc). In some examples, the memory 308 includes multiple kinds of memory, particularly volatile memory and non-volatile memory.

The memory 308 is computer readable media on which one or more sets of instructions, such as the software for operating the methods of the present disclosure can be embedded. The instructions may embody one or more of the methods or logic as described herein. In a particular embodiment, the instructions may reside completely, or at least partially, within any one or more of the memory 308, the computer readable medium, and/or within the processor 306 during execution of the instructions.

The terms "non-transitory computer-readable medium" and "computer-readable medium" should be understood to include a single medium or multiple media, such as a centralized or distributed database, and/or associated caches and servers that store one or more sets of instructions. The terms "non-transitory computer-readable medium" and "computer-readable medium" also include any tangible medium that is capable of storing, encoding or carrying a set of instructions for execution by a processor or that cause a system to perform any one or more of the methods or operations disclosed herein. As used herein, the term "computer readable medium" is expressly defined to include any type of computer readable storage device and/or storage disk and to exclude propagating signals.

The vehicle data bus 304 communicatively couples the body control module 102 and the keyless entry unit 104. The vehicle data bus 304 is implemented in accordance with the local interconnect network (LIN) protocol (as defined by the LIN specification 2.2A and later revisions). The body control module 102 and the keyless entry unit 104 are directly connected via the vehicle data bus 304 without other electronic control units (ECUs) communicatively coupled to the vehicle data bus 304. Alternatively, in some examples, the vehicle data bus 304 is implemented in accordance with (i) the controller area network (CAN) bus protocol (as defined by International Standards Organization (ISO) 11898-1), (ii) the K-Line protocol as defined by ISO 9141, (iii) the Media Oriented Systems Transport (MOST) bus protocol, or (iv) the CAN flexible data (CAN-FD) bus protocol (ISO 11898-7). In the illustrated example of FIG. 3B, the short-range wireless node 116 is directly connected to the body control module 102 via the vehicle data bus 304. The short-range wireless node 116 is wirelessly communicatively coupled to the keyless entry unit 104. In some examples, the wireless connection between the short-range wireless node 116 and the keyless entry unit 104 has a heightened security level (e.g., BLE security mode 2, 3, or 4, etc.).

Figure 4:
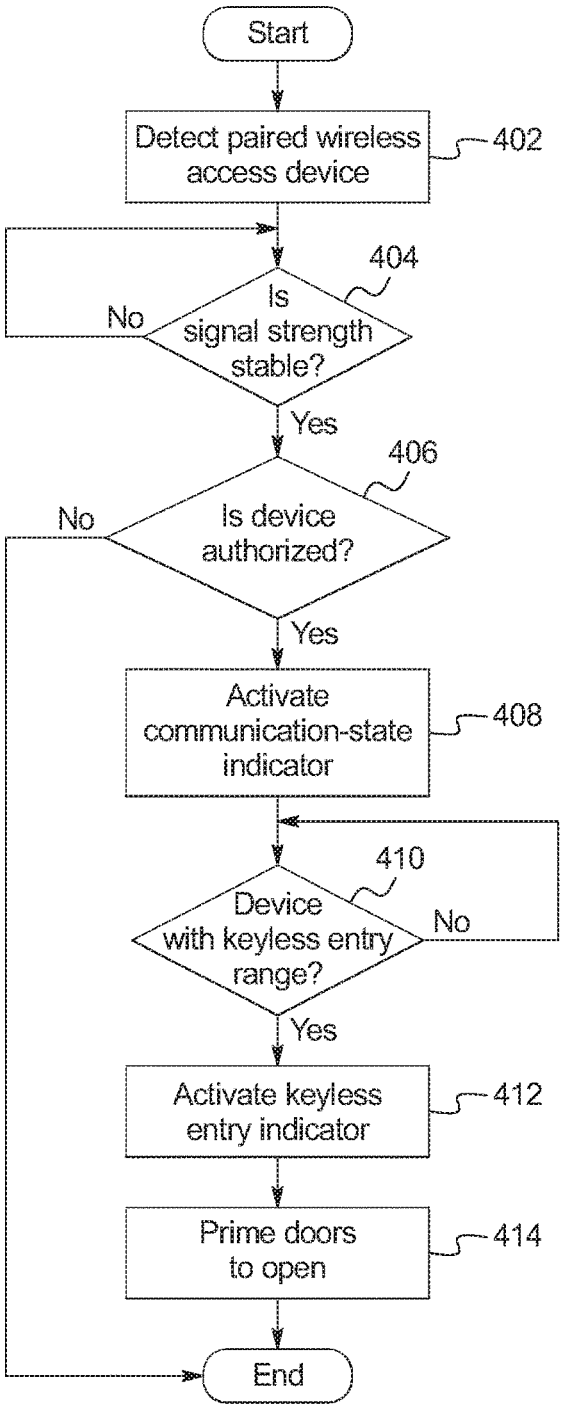
FIG. 4 is a flowchart of a method to operate the keyless entry system that may be implemented with the electronic components of FIGS. 3A and/or 3B.

FIG. 4 is a flowchart of a method to operate the keyless entry system that may be implemented with the electronic components 300 and 302 of FIGS. 3A and/or 3B. Initially, at block 402, the keyless entry unit 104 detects, via the short-range wireless node 118, detects a paired wireless access device (e.g., the key fob 126 and/or the mobile device 128). At block 404, the keyless entry unit 104 waits until the signal strength between the keyless entry unit 104 and the key fob 126 and/or the mobile device 128 is stable. For example, the RSSI value or the RX value may indicate the signal strength is weak (e.g., is below a signal strength threshold). As another example, after an initial connection, the keyless entry unit 104 may not receive acknowledge messages from the wireless access device. At block 406, the body control module 102 determines whether the wireless access device is authorized. For example, the body control module 102 may exchange security tokens with the wireless access device to determine whether the wireless access device is authorized. Examples of determining whether the wireless access device is authorized are described in U.S. Pat. No. 8,594,616, entitled "Vehicle Key Fob with Emergency Assistant Service," which is herein incorporated by reference in its entirety. If the wireless access device is not authorized, the method ends. Otherwise, if the wireless access device is authorized, the method continues at block 408.

At block 408, the keyless entry unit 104 activates the communication-state indicator LED 120 to emit a first color (e.g., yellow, blue, green, etc.) to indicate that the wireless access device is communicatively coupled to the vehicle 100 and is authorized to act as the key. At block 410, the body control module 102 waits until the wireless access device is within a range threshold (e.g., two to three meters, etc.) of the vehicle 100. For example, the wireless access device may initially communicatively couple to the vehicle 100 at twenty to thirty meters, but the body control module 102 may not prime to doors to open until the wireless access device is closer to the vehicle 100. In such a manner, the process of authorizing the wireless access device can begin before the user 108 reaches the vehicle 100 and the doors remain secure until the user 108 is relatively close to the vehicle 100. At block 412, the keyless entry unit 104 indicates that the doors are authorized to be unlocked or unlatched. In some examples, the keyless entry unit 104 changes the color emitted by the communication-state indicator led 120 (e.g., from yellow to blue, etc.). Alternatively or additionally, in some examples, the keyless entry unit 104 activates the lock-state indicator LED 121 to illuminate the lock-state indicator panel 205. Alternatively or additionally, in some examples, the keyless entry unit 104 activates the keypad LED 124. At block 414, the body control module 102 primes the door electronic latches 106 to unlock or unlatch.

The flowchart of FIG. 4 is representative of machine readable instructions that comprise one or more programs that, when executed by a processor (such as the processor 306 of FIGS. 3A and 3B), cause the vehicle 100 to implement body control module 102 of FIGS. 1A and 1B, and the keyless entry unit 104 of FIGS. 1A, 1B, and 2. Further, although the example program(s) is/are described with reference to the flowchart illustrated in FIG. 4, many other methods of implementing the example body control module 102 and the example keyless entry unit 104 may alternatively be used. For example, the order of execution of the blocks may be changed, and/or some of the blocks described may be changed, eliminated, or combined.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present instead of mutually exclusive alternatives. In other words, the conjunction "or" should be understood to include "and/or". The terms "includes," "including," and "include" are inclusive and have the same scope as "comprises," "comprising," and "comprise" respectively.

The above-described embodiments, and particularly any "preferred" embodiments, are possible examples of implementations and merely set forth for a clear understanding of the principles of the invention. Many variations and modifications may be made to the above-described embodiment (s) without substantially departing from the spirit and principles of the techniques described herein. All modifications are intended to be included herein within the scope of this disclosure and protected by the following claims.

What is claimed is:

1. A vehicle comprising:

a body control module to determine whether a wireless access device is authorized to act as a key; and a keyless entry unit communicatively coupled to the body control module, the keyless entry unit to vary a brightness of a first LED between fully on and fully off based on an received signal strength from the wireless access device when the wireless access device is connected to a wireless node.

2. The vehicle of claim 1, wherein the body control module is to, in response to determining that the wireless access device is authorized to act as the key, prime door electronic latches of the vehicle to unlock.

3. The vehicle of claim 1, wherein the keyless entry unit includes a second LED, the second LED emitting a color indicative of a mobile device not being authorized.

4. The vehicle of claim 1, wherein a color of the first LED is is different based on whether the wireless access device is authorized.

5. The vehicle of claim 1, wherein the keyless entry unit includes the wireless node within a body of the keyless entry unit.

6. The vehicle of claim 1, wherein the keyless entry unit includes a keypad and a keypad LED.

7. The vehicle of claim 6, wherein the keyless entry unit is to activate the keypad LED in response to detecting a person proximate the keyless entry unit, the keypad LED emitting a first color when a correct pass code has not been entered into the keypad and emit a second color when the wireless access device is authorized or the correct pass code has been entered into the keypad.

8. The vehicle of claim 1, wherein the keyless entry unit is located proximate a B-pillar on a door of the vehicle.

9. The vehicle of claim 1, wherein the keyless entry unit is located on a front windshield of the vehicle.

10. The vehicle of claim 1, wherein the keyless entry unit is located on a rear windshield of the vehicle.

11. A method comprising:

determining, with a processor, whether a wireless access device is authorized to act as a key; and activating, on a keyless entry unit, a connection indicator LED at a variable brightness between being fully on and fully off when the wireless access device is connected to a vehicle-based wireless node, the connection indicator LED emitting a first color, the variable brightness based on open path signal strength between the wireless access device and the vehicle-based wireless node.

12. The method of claim 11, including, in response to determining that the wireless access device is authorized to act as the key and the wireless access device is within a range threshold from a vehicle, priming door electronic latches of the vehicle to unlock.

13. The method of claim 11, wherein the keyless entry unit includes the vehicle-based wireless node within a body of the keyless entry unit.

14. The method of claim 11, wherein the keyless entry unit includes a keypad and a keypad LED.

15. The method of claim 14, including:

activating the keypad LED in response to detecting a person proximate the keyless entry unit;

adjusting the keypad LED to emit a third color when the wireless access device is not authorized and a correct pass code has not been entered into the keypad; and adjusting the keypad LED to emit a fourth color when the wireless access device is authorized or the correct pass code has been entered into the keypad.

16. The method of claim 11, wherein the keyless entry unit includes a lock indicator LED; and including, when the wireless access device is authorized:

activating the lock indicator LED to emit a third color when the wireless access device is outside a range threshold from a vehicle; and activating the lock indicator LED to emit a fourth color when the wireless access device is within the range threshold from the vehicle.

17. The method of claim 11, wherein the keyless entry unit is located proximate a B-pillar on a door of a vehicle.

18. The method of claim 11, wherein the keyless entry unit is located on a front windshield of a vehicle.

* * * * *